US005228657A

United States Patent [19]

Hall

[11] Patent Number: 5,228,657

[45] Date of Patent: Jul. 20, 1993

[54] GUY WIRE SUSPENSION APPARATUS

[76] Inventor: Gaddis G. Hall, P.O. Box 835, Trussville, Ala. 35173

[21] Appl. No.: 800,288

[22] Filed: Nov. 29, 1991

[51] Int. Cl.[5] ..... E04H 12/005

[52] U.S. Cl. ..... 248/230; 248/218.4; 52/148

[58] Field of Search ..... 248/230, 218.4, 227, 248/72, 63, 541; 52/149, 150, 151, 148

[56] References Cited

U.S. PATENT DOCUMENTS

| | | | |
|---|---|---|---|
| 901,652 | 10/1908 | Seydel | 248/227 |
| 1,548,190 | 8/1925 | Cronquist | 52/148 X |
| 1,864,651 | 6/1932 | Hawley | 248/230 X |
| 2,583,287 | 1/1952 | Andrews | 52/148 X |
| 2,703,216 | 3/1955 | Petersen | 248/231.6 X |
| 2,705,121 | 3/1955 | Kaminky et al. | 248/230 |
| 2,706,023 | 4/1955 | Merritt | 52/148 |
| 2,910,261 | 10/1959 | Ward et al. | 248/230 |
| 3,368,319 | 2/1968 | Werner et al. | 52/148 X |
| 3,405,896 | 10/1968 | Eby | 52/148 X |

*Primary Examiner*—Karen J. Chotkowski
*Attorney, Agent, or Firm*—Veal & Associates

[57] ABSTRACT

Apparatus for securing a guy wire to a utility pole including a belt having a plurality of links wrapped in pressed abutment with the pole, means for drawing the belt in pressed abutment with the pole and at least one guy wire attachment connected to one or more selected links and depending below the belt for receiving and partially supporting a guy wire in pressed abutment with the pole.

1 Claim, 5 Drawing Sheets

GUY WIRE SUSPENSION APPARATUS

FIELD OF THE INVENTION

The present invention relates to suspension brackets and more specifically to suspension brackets for connecting electrical equipment to a utility pole. In greater particularity the present invention relates to suspension brackets for connecting a guy wire to a utility pole.

BACKGROUND OF THE INVENTION

Guy wires are typically used to support a utility pole in an upright position. The guy wire is attached to the pole at a point proximate the upper end thereof and to a stationary anchorage, usually the ground. A variety of brackets for attaching a guy wire to a utility pole exist in the electrical industry and can be loosely categorized into two types based upon the means used to attach the bracket to the utility pole.

The first type of bracket is attached to the pole by a bolt. A hole is drilled through the pole and the bracket is secured thereto by inserting a bolt through the bracket and the pole, thereafter securing the bolt thereto with a threadably adapted nut. This method of attachment is traditionally used to attach guy wires to a wooden utility pole through which a hole can be easily drilled.

Utility poles constructed of more durable materials, such as reinforced concrete or steel, require a second type of bracket as the drilling of a bolt hole through such poles is difficult at best and even when successfully drilled could substantially weaken the strength of the pole. The second type of bracket includes a belt concentrically wrapped about the utility pole and a connector affixed to the belt for engaging the uppermost end of the guy wire. The guy wire is connected directly to the connector and does not contact either the belt or the utility pole.

The belts used to support such connectors are basically supported on the pole by the frictional forces created by the tightened abutment of the belt with the pole. The belts can only withstand a predetermined limit of force exerted thereon without breaking or slipping down the pole. Since the connector is affixed to the belt and the guy wire is exclusively connected to the connector, the full weight of the guy wire and any other forces exerted thereon pull directly against the connectors and thus the belt. Such belts have a predetermined limit of force that may be exerted thereon before such belts will break; therefore, apparatus is needed to minimize the weight exerted on such belts by a guy wire.

SUMMARY OF THE INVENTION

It is the principal object of the present invention to provide an improved bracket for connecting a guy wire to a utility pole.

In support of the principal object, another object of the invention is to provide an improved bracket that minimizes the forces exerted thereon by the guy wire.

These and other objects and advantages of my invention are accomplished through the use of a pole belt having a plurality of links pivotally interconnected in series and concentrically wrapped about a utility pole in pressed abutment therewith. At least one guy wire attachment is connected to the pole belt and depends a predetermined distance therebelow having a loop for receiving a guy wire therein, wherein said guy wire extends around said utility pole in pressed abutment therewith being partially supported thereon by the guy wire attachment. A portion of the force exerted by and along the guy wire is supported by the pole thereby reducing the stress exerted on the pole belt.

BRIEF DESCRIPTION OF THE DRAWING

Apparatus embodying features of my invention are depicted in the accompanying drawings which form a portion of this disclosure and wherein.

DESCRIPTION OF A PREFERRED EMBODIMENT

Figure 1:
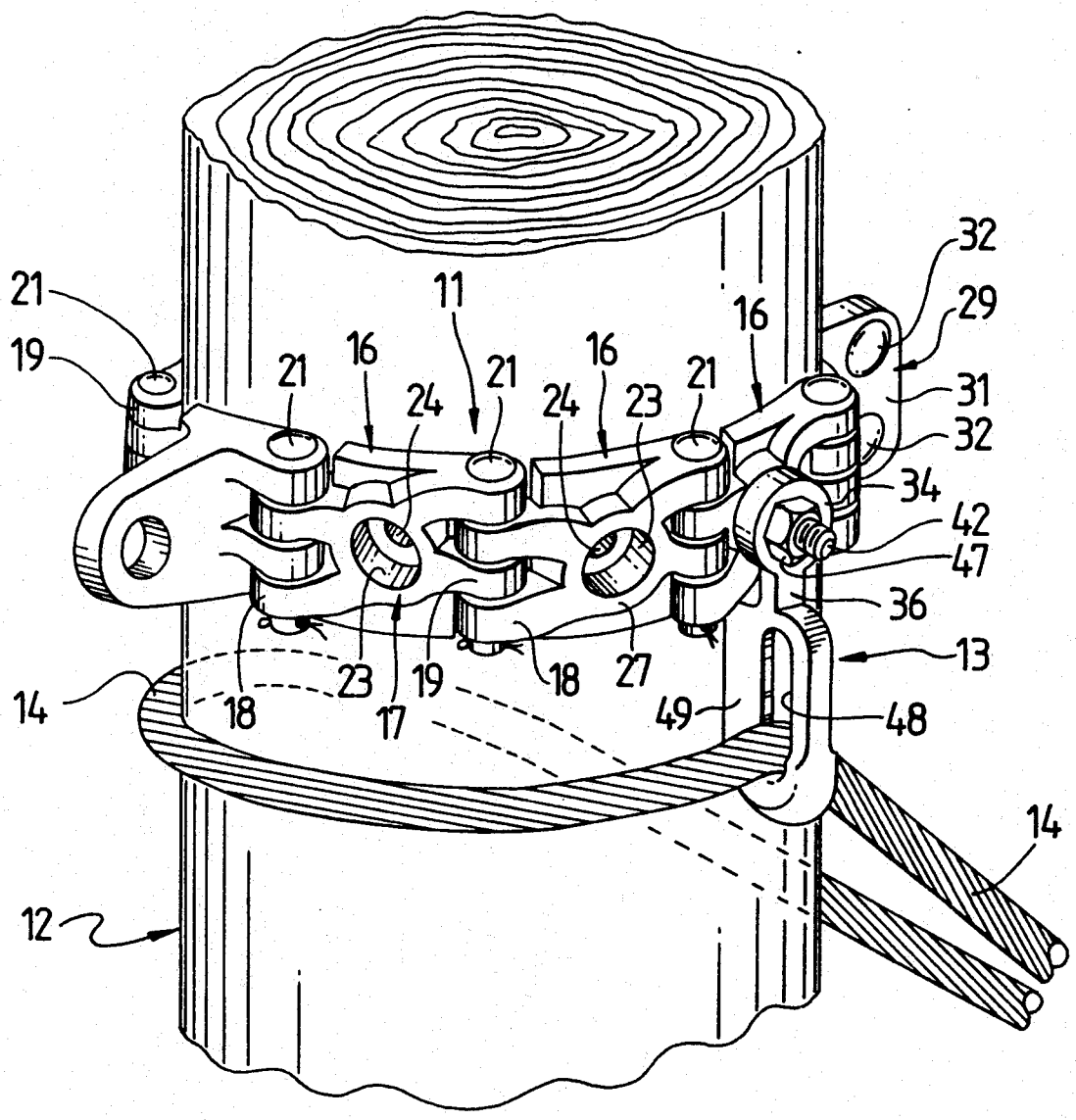
FIG. 1 is a perspective view of the present invention connected to a utility pole and supporting a guy wire.

Referring to the drawings for a clearer understanding of the invention, it should be noted in FIG. 1 that the present invention contemplates the use of a pole belt 11 encircling a utility pole 12 in pressed abutment therewith having at least one guy wire attachment 14 connected thereto for partially supporting a guy wire 13 at a selected height on the utility pole 12, wherein the guy wire 13 extends through the guy wire attachments 14 and around the utility pole 12.

Figure 2:
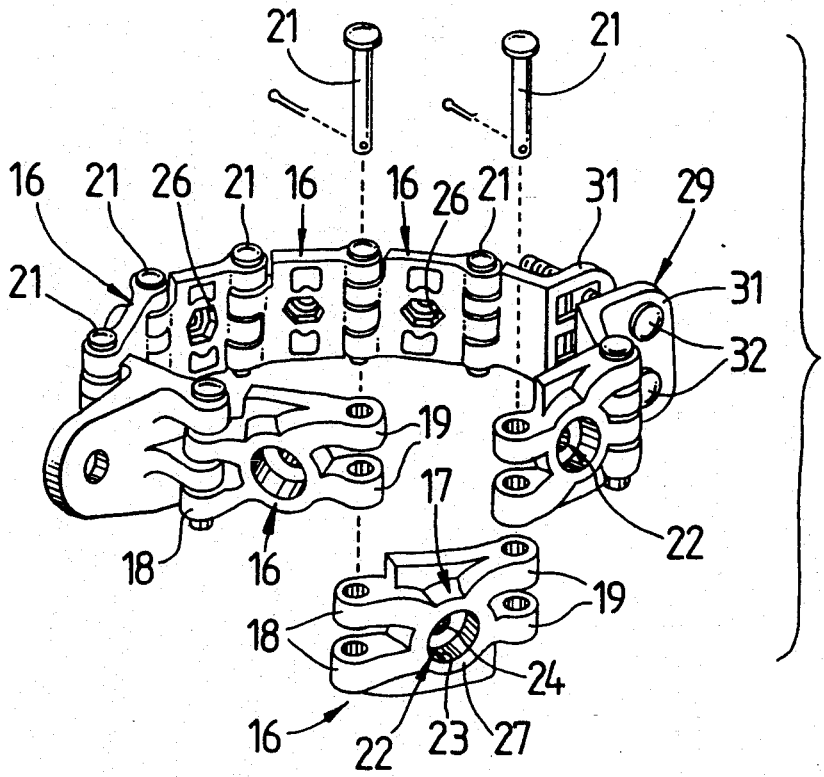
FIG. 2 is a partially exploded perspective view of a pole belt.

As shown in FIG. 2, the pole belt 11 includes a series of hingedly connected links 16, and as shown in FIGS. 2–6, each link 16 includes a body 17, a lower clevis 18 integrally connected to the body 17 and an upper clevis 19 connected to the body 17 opposite the lower clevis 18. The upper clevis 19 is spaced above the lower clevis 18 to intermesh with an adjacent lower clevis 18 of the next adjacent link 16, wherein two adjacent links 16 form a hinge connected by one of a plurality of pins 21 which extends through the intermeshed clevises.

Figure 4:
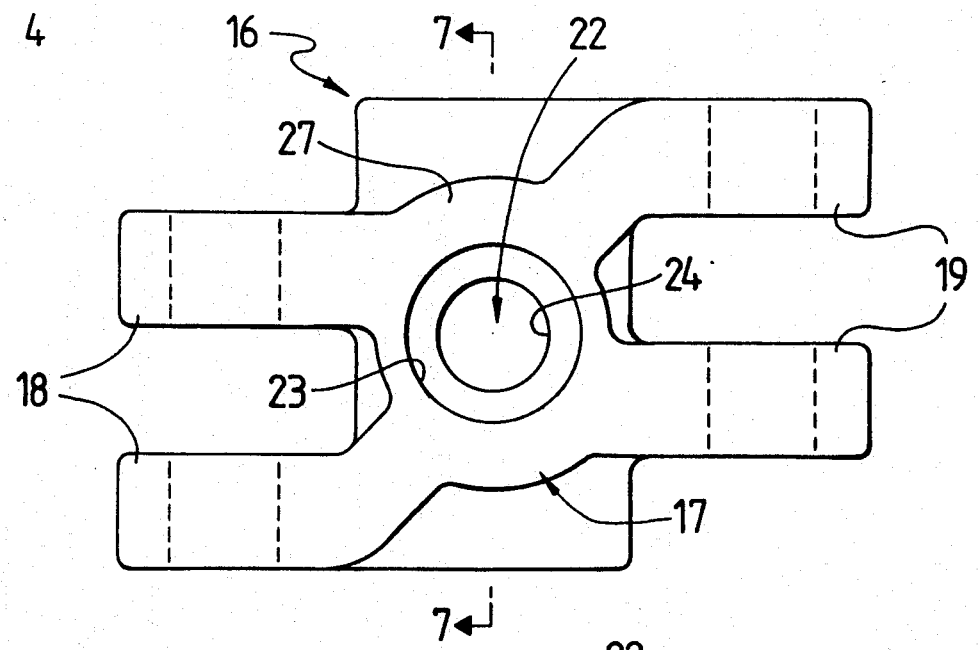
FIG. 4 is a side elevational view of a link.
Figure 5:
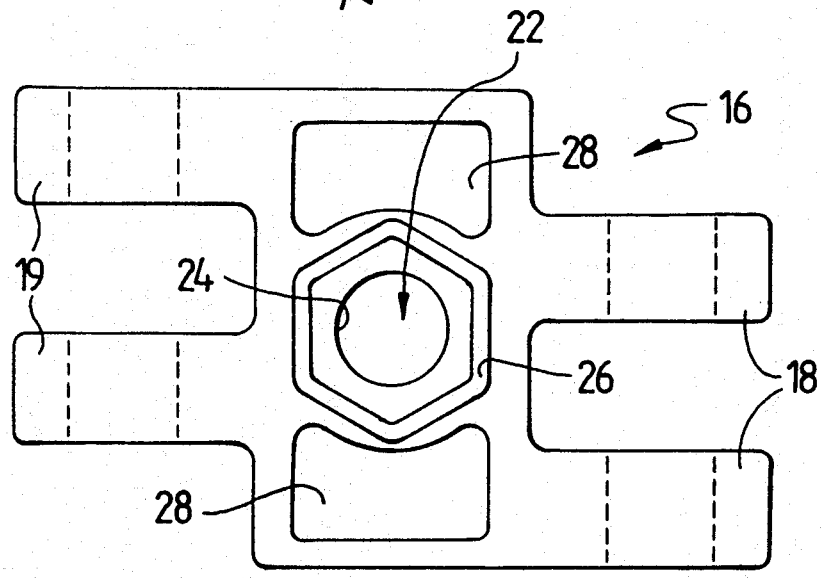
FIG. 5 is a side elevational view of a link taken opposite that shown in FIG. 4.
Figure 6:
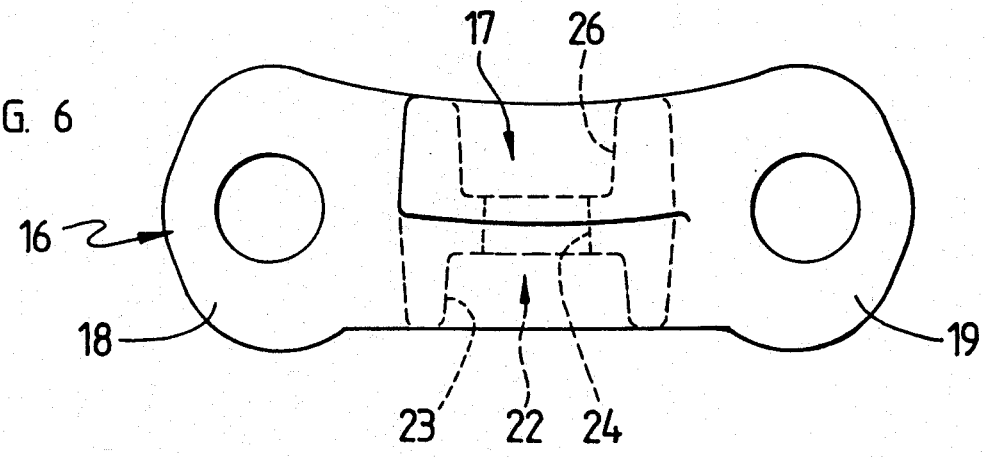
FIG. 6 is a plan view of the link shown in FIG. 4.
Figure 7:
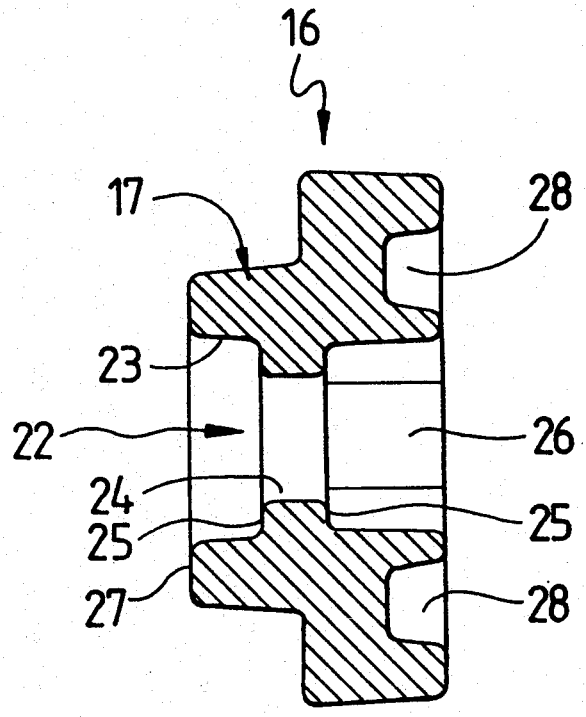
FIG. 7 is a sectional view taken along line 7—7 of FIG. 4.

As shown in FIGS. 4, 6, and 7, the body 17 has a central aperture 22 therethrough defined by a first cylindrical portion 23, an inner, reduced diameter, cylindrical portion 24 joining the first cylindrical portion at a shoulder 25, and an innermost hexagonal portion 26 having a diameter greater than said inner portion 24 and joined thereto at a shoulder 25'. A reinforcing boss 27 surrounds the aperture and extends the hexagonal portion 26 toward the pole. A pair of channels 28 are formed by said body 17 each extending either above or below said hexagonal receptacle 26 in spaced relation thereto.

Figure 8:
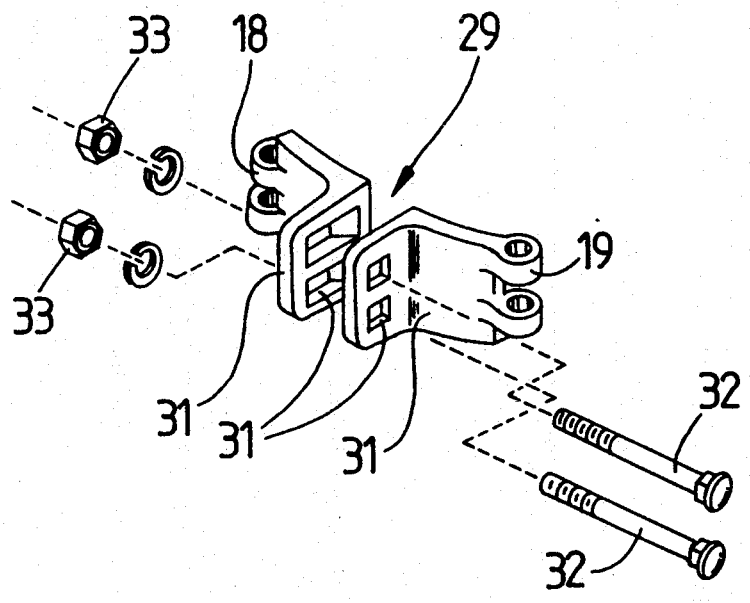
FIG. 8 is an exploded perspective view of a belt clip.

As shown in FIGS. 2 and 8, a belt clip 29 is connected intermediate a selected pair of links 16 and includes a pair of flanged portions 31. Each flanged portion 31 is hingedly connected to an adjacent one of the selected links 16 and detachably connected to the other of the pair of flanged portions 31. A pair of bolts 32 extend through a pair of range taking apertures **31*a* in said flanged portions 31 and are secured therein by a pair of nuts 33 which operatively engage a threaded end of the bolts 32. As the nut and bolt combination is tightened, the flange portions 31 are urged toward each other thereby tightening the belt links 16 about the pole 12**.

The guy wire attachments 14 are detachably connected to one or more links 16 and include a base 34, a shank 36 integrally connected to the base 34 and depending therefrom, and a guy wire receiving loop 37 connected to the shank 36 in opposing relation to the base 34. The base 34 includes a cylindrical extension 38 having a diameter slightly less than the diameter of the first cylindrical portion 23, of the link 16, such that the cylindrical extension 38 may be slidably received in the first cylindrical portion 23. The base 34 has a diameter greater than the first cylindrical portion 38. A cylindrical bolt hole 41, having a diameter at least as great as the reduced diameter cylindrical portion 24, extends through the base 34 and cylindrical extension 38 in coaxial relation thereto.

Figure 3:
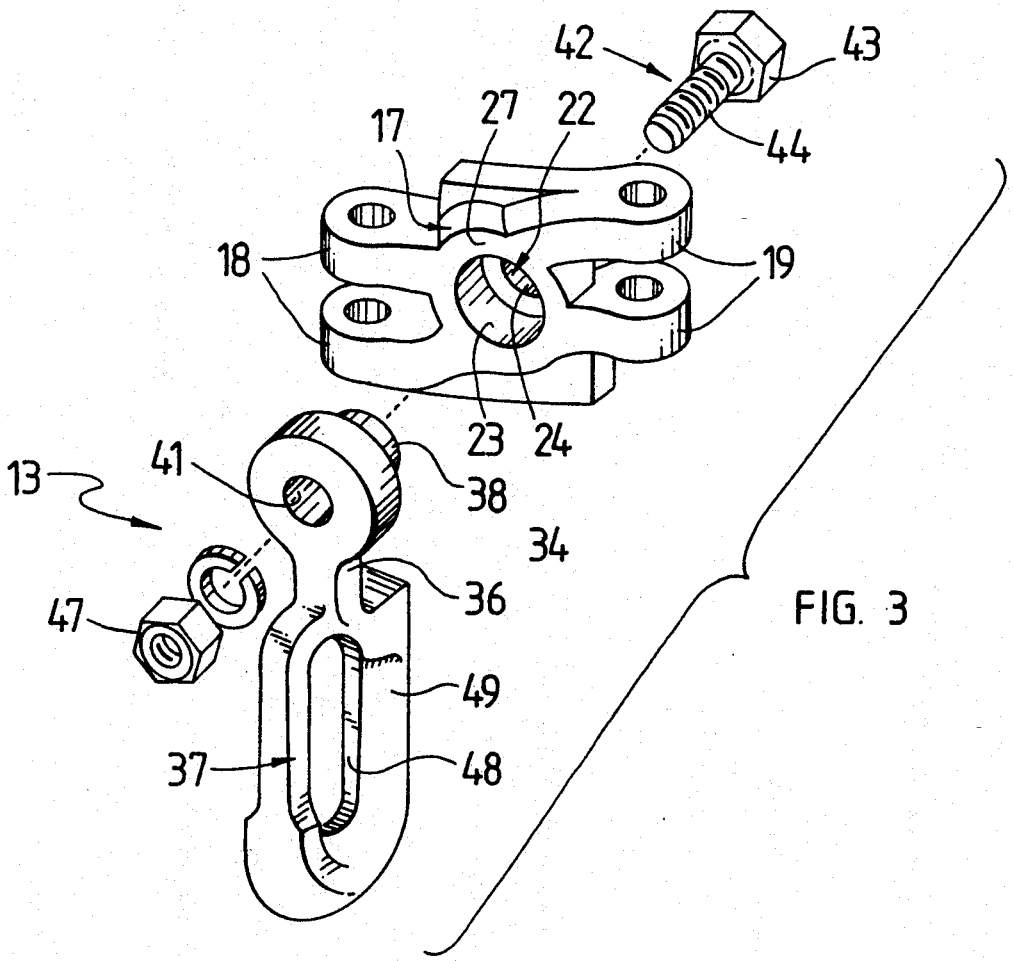
FIG. 3 is an exploded perspective view of a link and guy wire attachment.

To connect the guy wire attachment 14 to a selected link 16, the cylindrical extension 38 is inserted within the first cylindrical portion 23, thus bringing the base 34 into contact with body 17 about the periphery of the aperture 22 therethrough. As shown in FIG. 3, a bolt 42 having a hexagonal head 43 and a threaded shaft 44 is inserted through the aperture 22, such that the head 43 is received within the hexagonal portion 26 in non-rotational abutment with the interior walls 46 thereof. The shaft 44 extends through the aperture 22 and the bolt hole 41 beyond the base 34 to threadably engage a nut 47. The nut 47 can be tightened to hold the base 34 in non-rotational contact with the link 16 or loosened to permit rotational movement of the guy wire attachment 14.

With the base 34 thus connected to a selected link 16, the shank 36 depends from the base 34 to a point below the link 16. The loop 37 has an oval orifice 48 therein through which the guy wire 13 is threaded and upon which the guy wire is partially supported. Loop 37 includes a reinforced brace portion 49 which rests against the utility pole 12 such that any torque applied on the loop by the guy wire is transferred therethrough to the pole and is not exerted on the shank 36.

Figure 9:
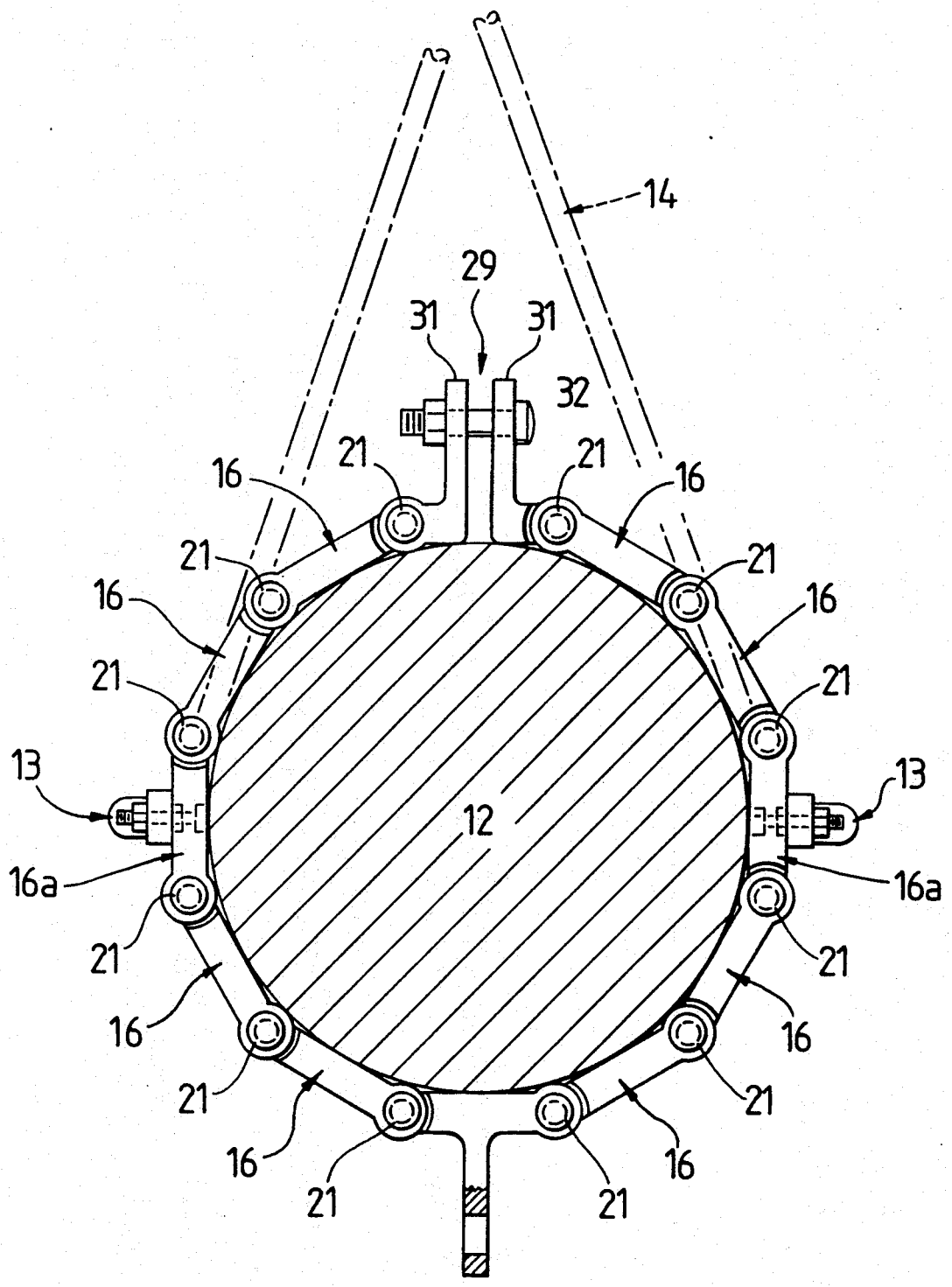
FIG. 9 is a partially sectioned plan view of the present invention encircled about a utility pole.

Though any number of guy wire attachments 14 may be connected to the belt 11, the preferred arrangement is shown in FIG. 9 and includes two such attachments 14 connected to diametrically spaced links **16*a*. The guy wire 13 is threaded through the loops 37 and pulled in pressed abutment with the pole 12 below the belt 11. The ends of the guy wire 13 are connected to a stationary anchor (not shown) with the guy wire 13 extending from the pole 12 at some predetermined angle. The engagement of the pole 12 by the guy wire 13, as facilitated by the partial support provided by the guy wire attachments 14, transfers a portion of the force exerted by the guy wire 13 directly to the pole 12, thereby reducing the strain on the belt 11 as compared to having the guy wire 13 exclusively connected to the belt 13. As the angular relationship between the gu wire 13 and the utility pole 12 is increased to a maximum of 90°, the proportion of force exerted by the guy wire 13 on the belt 11** is decreased to a minimum of zero. From the foregoing, it should be clear that the present apparatus represents a substantial improvement over the prior art.

While I have shown my invention in one form, it will be obvious to those skilled in the art that it is not so limited but is susceptible of various changes and modifications without departing from the spirit thereof.

What I claim is:

1. Apparatus for suspending a guy wire from a utility pole while directing a substantial portion of the forces exerted by said guy wire into direct contact with said utility pole thereby minimizing the amount of force exerted on said suspension apparatus comprising:

(a) a pole belt, comprising a series of pivotally interconnected wrapped around links, held concentrically in pressed abutment with a utility pole by fastening means connected intermediate two of said plurality of links for drawing said link in pressed abutment with said utility pole;

(b) a guy wire attachment connected to a selected link of said series of links and depending a predetermined distance therefrom, wherein said guy wire extends through said guy wire attachment and around said utility pole in abutment therewith, whereby said guy wire is partially supported by the lateral abutment thereof with said utility pole, said guy wire attachment including a base connected to said selected link, a shank integrally connected to said base and extending below said pole belt and a loop integrally connected to a lower end of said shank for receiving said guy wire and partially supporting said guy wire a predetermined distance below said pole belt wherein said base comprises a cylindrical extension slidably received within a cylindrical portion formed by said selected link, said cylindrical extension being secured in said cylindrical portion by a bolt extending through said link and said cylindrical extension in coaxial relation thereto and a nut threadably connected to said bolt.

* * * * *